United States Patent [19]

Morris

[11] Patent Number: 4,598,844

[45] **Date of Patent: * Jul. 8, 1986**

[54] CONTAINER AND DISPENSER FOR MATERIAL IN GRANULAR OR POWDER FORM

[76] Inventor: William Morris, 383 Wllsworth Ave., New Haven, Conn. 06511

[ * ] Notice: The portion of the term of this patent subsequent to May 15, 2001 has been disclaimed.

[21] Appl. No.: 644,792

[22] Filed: Aug. 27, 1984

[51] Int. Cl.[4] ..... A47G 19/24

[52] U.S. Cl. ..... 222/196.2; 222/196.5; 222/565

[58] Field of Search ..... 222/196.1, 196.2, 196.3, 222/196.4, 196.5, 511, 518, 501, 463, 494, 407, 496, 547, 565, 564; 239/374, 602, 590.3, 590.5; 366/130, 339; 248/618, 624

[56] References Cited

U.S. PATENT DOCUMENTS

| | | | |
|---|---|---|---|
| 244,740 | 7/1881 | Brown . | |
| 1,628,106 | 5/1927 | Booty . | |
| 1,816,141 | 7/1931 | Booty . | |
| 2,107,228 | 2/1938 | Zimmerman | 222/196.4 |
| 2,729,363 | 1/1956 | Bauer et al. | 222/565 |
| 2,779,518 | 1/1957 | Morris | 222/518 |
| 4,448,334 | 5/1984 | Morris | 222/518 |

*Primary Examiner*—Joseph J. Rolla
*Assistant Examiner*—Nils E. Pedersen
*Attorney, Agent, or Firm*—Costas, Montgomery & Dorman

[57] ABSTRACT

A container and dispenser for granular or powdered material in which the container has an upper aperture and dispensing orifices are defined by a flexible member which permits the orifices to be expanded with resulting contraction to break loose clogged material from the orifices. The flexible member is in the form of a conical spring having spaced notches along the length thereof to channel the condiment through the grooves and provide a more uniform dispensing pattern of the condiment.

7 Claims, 4 Drawing Figures

CONTAINER AND DISPENSER FOR MATERIAL IN GRANULAR OR POWDER FORM

FIELD OF THE INVENTION

This invention relates to containers and dispensers for material in granular or powder form and, more particularly, relates to condiment containers and shakers or dispensers.

BACKGROUND OF THE INVENTION

In containers or dispensers for material in granular or powder form, as for example salt and pepper shakers, it is often found that the opening or openings in the containers become clogged, requiring the cap to be removed and the dispensing apertures wiped clean to unclog the openings. While this is primarily true in the case of salt and pepper shakers, it may also occur in other dispensing devices for other food substances, such as sugar or flour, or cornstarch may be wished to be dispensed in limited amounts, rather than measured in tablespoons or teaspoons or other measures.

U.S. Pat. No. 4,448,334 of the same applicant discloses a container and dispenser for material in granular or powder form which utilizes a conical spring element depending into a container. The spaces between the helices of the spring member define dispensing orifices and permit the contents of the container to be dispensed therebetween. If the contents of the container clog the openings between the helices, the container may be impacted on a surface to shock or vibrate the spring and cause it to expand, breaking the clogged material loose from the helices.

The present invention may be considered, in some respects, as an improvement to the dispenser of U.S. Pat. No. 4,448,334.

SUMMARY OF THE INVENTION

Briefly stated, the invention in one form thereof comprises a container having an aperture therein. A conical spring element is disposed in the aperture and supported by the means defining the aperture.

Defined in the wire defining the conical spring are spaced apart notches cut transverse to the length of the wire. The spacings between the helices of the conical spring are dimensioned to inhibit pouring of the condiment through the spaces. The transverse grooves in the wire of the spring are dimensioned to permit the condiment to pass therethrough. This arrangement patterns the discharge of the condiment over the helices, so that the dimensioning between the helices minimize pouring and directs the condiment between the grooves.

A further aspect of the invention is the manner in which the dispensing spring is mounted to the housing. The housing or a cap therefor defines an aperture which has an inwardly protruding shoulder. The spring is formed with an upper coil of large dimension, one or two succeeding coils of lesser dimension and then another coil of substantially equal dimension to the first coil. The second coil(s) of lesser dimension is received at the shoulder with the coils of larger dimension grasping either side of the shoulder to secure the dispensing spring at the aperture.

The aperture defining means including a shoulder may be made a portion of the container or be defined on a cap which is fitted to the container. In the former case, the opening for filling the dispenser will be at the bottom of the dispenser. This arrangement of the formation of the spring's second coil(s) and the shoulder acts to delay the spilling tendency from a shaker lower portion during the initial inverting of the container and its return to a vertical position after shaking the container and dispensing the condiments. The shoulder acts as a blocking device so that residue in the orifice such as salt can gravity feed back into the holder when it is returned to an upright position.

An object of this invention is to provide a new and improved dispenser for condiments and other material in granular or powder form in which clogging may be easily overcome and in which an improved pouring or shaking pattern of the condiments is achieved.

Another object of this invention is to provide a new and improved mechanism for securing a condiment dispensing device in a condiment container.

A further object of the invention is to provide means in the orifice to inhibit the spilling of the contents from the lower portion during the initial inverting of the container and its return to vertical position after shaking the container and dispensing the condiment.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DESCRIPTION OF PREFERRED EMBODIMENTS OF THE INVENTION

Figure 1:
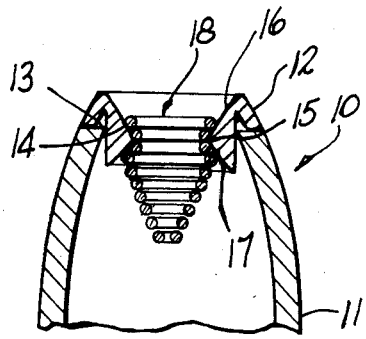
FIG. 1 is a longitudinal sectional view of a container and dispenser for granular and powdered material where the lower portion of the container is cut away.

As shown in the drawings where like reference numerals throughout the figure represent like elements, a condiment container 10 embodying the invention in one form thereof comprises a base member 11 which receives a cap member 12 at the upper end thereof. Cap member 12 is received in an aperture defined at the upper end of container 10 and is frictionally received therein. Cap member 12 may be of a slightly deformable plastic material which engages the edge 13 of container 10 which defines the upper aperture. The fit between cap member 12 and container 10 is such that the cap member may be removed to fill the container 10. In alternate constructions, cap member 12 may be made integral with container 10 and the container 10 then would have a closeable bottom opening (not shown) for filling of the container. Also, rather than the frictional fit as shown, the cap member 12 could be threaded to container 10.

Cap member 12 has an inwardly extending shoulder 14 which preferably comprises an apex 15 defined by the juncture of inclined annular surfaces 16 and 17. A dispensing member in the form of a spring is secured to cap member 12 with the portion of the spring below shoulder 15 being of conical shape and depending into container 10.

Spring 18 is formed with closed coils 20, 21, 22 and 23. The closed coils include two coils 20 and 23 of larger diameter than the coils 21 and 22. The purpose of this construction is to lock or affix the spring 18 to the cap member 12 or the aperture defining means of container 10 if container 10 should be formed to have an integral portion in the shape of cap 12. Spring 18 also includes helices 24, 25, 26, 27, 28 and 29 of decreasing diameter. The spring may be formed with only one of coils 21 and 22 if desired.

Due to the resilience of spring 18, it may be initially inserted into cap member 12 merely by pressing it downwardly until the coil 20 rests on the surface 16. At this time, the apex 15 of shoulder 14 will engage the coils of the helices 21 and 22 in slight compression and the helices 20 and 23 will bear on surfaces 16 and 17, respectively. The dimensioning of the helices 20 and 23 and the angle of the surfaces 16 and 17 is preferably such that there is slight tension in the spring between the helices 20 and 23. However, there should be no separation sufficient to permit a substance in container 10 to collect between the closed coils 20–23.

The spring 18 may be shocked by impacting container 10 to break any accumulation of material from the orifices 32. Alternately, the spring 18 may be stretched by any other means to expand it and break an accumulation of material thereon.

Figure 3:
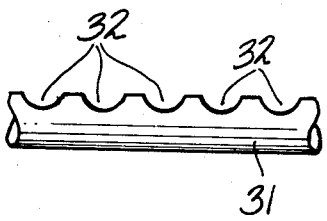
FIG. 3 is a view of a section of the wire which forms the helical spring of FIG. 2.

FIG. 3 exemplifies a section of a length of wire 31 which may form the spring 18. The wire 31 is acted upon to define a plurality of notches 32 along the length thereof which serve as dispensing orifices when the wire 31 is formed into the spring 18. The notches may be formed mechanically as by the use of a plurality of cutting disks, by laser or by any other suitable means. The notches 32 are formed such that the depth of the notches 32 may be one-third of the diameter of wire 31 or such a dimension that will permit the condiment or other substance in container 10 to pass through the notches 32. The spacing of the helices 21–22 is such as to inhibit pouring of the contents of container 10 when it is initially raised for inversion.

Figure 2:
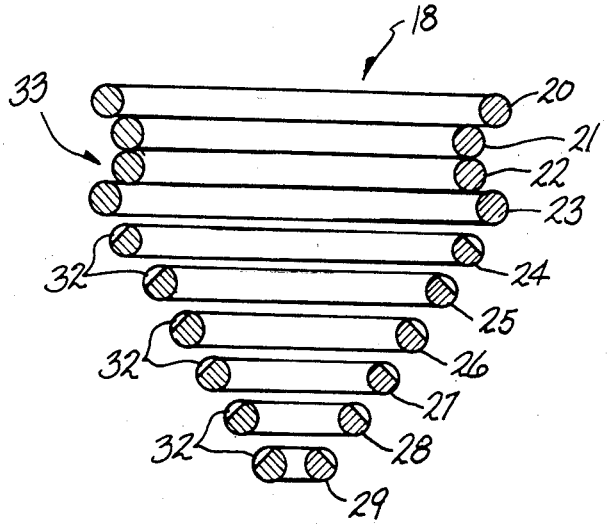
FIG. 2 is a longitudinal half-section of a helical dispensing spring which is utilized in the device of claim 1.

The wire 31 is formed into the spring after having the notches 32 defined therein so that the notches 32, as shown in FIG. 2, define shaking orifices with the underside of the next uppermost helix (as shown in FIG. 2). The spacing between the helices, without the notches formed therein, is insufficient to permit pouring of the condiment or contents of container 10 between the helices.

For purposes of example only, the wire 31 from which the spring 18 is formed, may be of 0.030 inches, the spacing between the helices along the longitudinal axis of spring 18 being about 0.006 inches, while the notches would be defined in wire 31 to a depth of 0.010 inches. These dimensions are given only for purposes of example for a container designed for salt and having the first coil 20 of one-half inch diameter. The coils may taper in diameter to a lower coil of 0.045–0.055 inches, internal diameter, to permit gravity feed of any residue in the open portion of the spring to the container 10. The dimensions may vary for other substances and the diameter of the wire can change with diameter increase or decrease of the first coil.

With this construction, defined about each helix is an annular array of shaking orifices 32 which permit the condiment or other substance in container 10 to be shaken from container 10 through the notches 32 in several annular patterns and thus establish a more uniform shaking pattern for the condiments or other substance in container 10.

The construction of the aperture shoulder apex cap 15 combined with inclined surfaces 16 and 17 is very important in inhibiting initial pouring of the substance in container 10 as it is being inverted. The inwardly extending shoulder or flange 14 is compatible with 21–22 of the spring and acts to inhibit free flow of the substance which may pass through the notches 32 as the container 10 is raised and turned to be inverted.

This construction also inhibits any flow of the contents as the container 10 is returned towards a horizontal position after a shaking and dispensing operation has been performed.

The notches 32 are substantially perpendicular to the length of the wire. The depth of the notches will be a function of the spacing between the coils of spring 18. If the spacing is decreased, the depth of the notches will be increased and vice versa.

Figure 4:
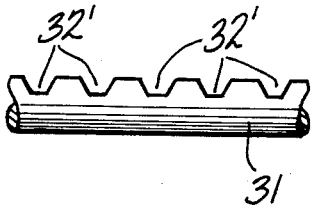
FIG. 4 is a view of a section of an alternate form of wire which may form the helical spring of FIG. 2.

FIG. 4 shows a partial length of wire 31 similar to FIG. 3 but where the notches 32' are formed of a generally inverted trapezoidal shape. It will be understood that the shape of the notches may take any form that is consistent with providing suitable orifices for dispensing of the material in container 10 therethrough.

The construction of the spring 18 is intended to provide a good frictional fit on the flange or shoulder 14. However, if desired, an adhesive may be applied in the recess 33 defined by the helices 20 and 23 and the smaller diameter helices 21 and 22 to adhere spring 18 into the aperture defined by shoulder 14.

It may thus be seen that the objects of the invention set forth, as well as those made apparent from the foregoing description, are efficiently attained. Preferred embodiments of the invention have been set forth for purposes of disclosure; however, modifications to the disclosed embodiments of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A device for containing and dispensing material in granular or powder form comprising a container, means defining an outlet opening at an end of said container, a spring member of conical shape defined by a plurality of helices of decreasing diameter about a longitudinal axis, said member being affixed to said container in said opening and depending into said container, said spring member being formed of wire, a plurality of notches defined in said wire transverse of the length of said wire, the notches in one helix defining with an adjacent helix an annular array dispensing apertures in each helix.

2. The device of claim 1 where the spacing between said helices of said conical spring is of a dimension which inhibits free pouring of the contents of said container.

3. The device of claim 1 where said means defining an outlet opening is a cap on said container.

4. The device of claim 1 wherein the smallest helix of said spring is dimensioned to define an opening which will permit gravity feed of the condiment into said container after the container is returned to an upright position.

5. A device for containing and dispensing material in granular or powder form comprising a container, means defining an outlet opening at an end of said container, said defining means providing an annular shoulder, a spring member of conical shape defined by helices of decreasing diameter about a longitudinal axis extending into said container, said spring member having first helices of a diameter greater than the diameter of said shoulder with at least one helix of lesser diameter therebetween, said first helices being positioned on either side of said shoulder to affix said spring member to said container.

6. The device of claim 5 where said shoulder is formed at an apex by two annular inclined surfaces.

7. The device of claim 5 where said first helices are spaced on either side of two helices of lesser diameter, said first helices and said helices of lesser diameter having essentially no spacing therebetween.

* * * * *